US011845479B2

(12) United States Patent
Wimberger et al.

(10) Patent No.: US 11,845,479 B2
(45) Date of Patent: Dec. 19, 2023

(54) DRAINAGE DEVICE FOR A WINDOW

(71) Applicant: SIEMENS MOBILITY GMBH, Munich (DE)

(72) Inventors: Thomas Wimberger, Freising (DE); Herbert Kammerloher, Biburg (DE)

(73) Assignee: Siemens Mobility GmbH, Munich (DE)

( * ) Notice: Subject to any disclaimer, the term of this patent is extended or adjusted under 35 U.S.C. 154(b) by 674 days.

(21) Appl. No.: 16/982,673

(22) PCT Filed: Mar. 11, 2019

(86) PCT No.: PCT/EP2019/055986
§ 371 (c)(1),
(2) Date: Sep. 21, 2020

(87) PCT Pub. No.: WO2019/179807
PCT Pub. Date: Sep. 26, 2019

(65) Prior Publication Data

US 2021/0009172 A1 Jan. 14, 2021

(30) Foreign Application Priority Data

Mar. 20, 2018 (DE) ..... 10 2018 204 236.5

(51) Int. Cl.
*B61D 23/00* (2006.01)
*B61D 25/00* (2006.01)

(52) U.S. Cl.
CPC ..... *B61D 25/00* (2013.01)

(58) Field of Classification Search
CPC ..... B61D 15/00; B61D 23/00; B61D 19/02; B61D 19/00; B61D 19/006; B61D 19/008; B60J 5/0408; B60J 5/00; B60J 5/04; E06B 3/70
See application file for complete search history.

(56) References Cited

U.S. PATENT DOCUMENTS

| | | | | |
|---|---|---|---|---|
| 1,451,021 | A | 4/1923 | Hanson | |
| 11,199,853 | B1 * | 12/2021 | Afrouzi | G05D 1/0246 |
| 11,377,128 | B2 * | 7/2022 | Hengstenberg | B61D 23/00 |
| 11,498,594 | B2 * | 11/2022 | Hengstenberg | B60J 1/007 |
| 11,618,484 | B2 * | 4/2023 | Hengstenberg | B61D 19/02 105/343 |
| 2013/0248022 | A1 * | 9/2013 | Roof | F04C 18/0215 137/544 |

FOREIGN PATENT DOCUMENTS

| | | | |
|---|---|---|---|
| CN | 2811090 | Y | 8/2006 |
| CN | 2013348829 | Y | 10/2009 |
| CN | 202913481 | U | 5/2013 |
| CN | 203783364 | U | 8/2014 |
| CN | 106740929 | A | 5/2017 |
| CN | 107355168 | A | 11/2017 |

(Continued)

*Primary Examiner* — Chi Q Nguyen
(74) *Attorney, Agent, or Firm* — Laurence A. Greenberg; Werner H. Stemer; Ralph E. Locher

(57) ABSTRACT

A drainage device, in particular for a shaft window, contains a vertically movable valve part which has a valve head and an immovable valve part valve which has a drain which can be dosed by the valve head in a closed position. The vertically movable valve part is arranged on a counter-weight.

9 Claims, 3 Drawing Sheets

(56) References Cited

FOREIGN PATENT DOCUMENTS

| | | | |
|---|---|---|---|
| DE | 202004008716 | U1 | 10/2005 |
| DE | 102004026737 | A1 | 12/2005 |
| GB | 2414262 | A | 11/2005 |
| JP | 2002229654 | A | 8/2002 |
| JP | 2013076309 | A | 4/2013 |
| KR | 20000046693 | A | 7/2000 |
| SU | 1382712 | A1 | 3/1988 |

* cited by examiner

DRAINAGE DEVICE FOR A WINDOW

BACKGROUND OF THE INVENTION

Field of the Invention

The invention relates to a drainage device, in particular for a shaft window, having a vertically movable valve part with a valve head, preferably valve cone, and an immovable valve part with a drain which can be closed by the valve head, and also a window.

Pressure-tight shaft windows which may be opened when required are frequently used in the region of rail vehicles. Depending on the weather, rainwater on the pane may enter the window frame. Furthermore, condensation water may be formed between an outer side of the window and a side thereof facing the interior space because of temperature differences.

In currently known pressure-tight shaft windows, drainage of the frame or of a water collecting trough arranged in the shaft window takes place via a valve when the window is opened.

For example, a drainage mechanism is known in which a valve cone is actuated via a linkage or a cable pull in order to open or close a drain. Said linkage is connected to an upper crosspiece of a spring assembly. If the window is opened, the springs are stretched and the crosspiece of the spring assembly raised, as a result of which the valve or the valve cone is opened. Since the valve cone has a fixed closing position within the mechanism, the valve may become uptight over time due to wear. When the valve is installed in a window, the contact pressure for each window also has to be set individually or the tolerances of the spring assembly have to be compensated for by a corresponding length setting of the linkage.

In the case of shaft windows having a counterweight, the drainage mechanism conventionally has a valve cone which is actuated via a contact plate. Said contact plate is pressed by the counterweight when the window is closed. The valve cone is thus in its closed position. If the window is opened, contact plate and valve cone are relieved of load and the drainage mechanism is opened. The valve cone is installed together with two springs in a sleeve. The larger spring causes an opening stroke of the valve. The smaller spring serves for producing the functionality of the valve in cooperation with the counterweight and the window lock.

The previously known mechanisms for activating or opening the valve are complicated in terms of installation and adjustment. Furthermore, the known drainage mechanisms have a complicated design.

SUMMARY OF THE INVENTION

It is an object of the invention to propose a window and a simplified drainage mechanism that eliminates the aforementioned disadvantages.

The object is achieved by the subject matter of the independent patent claims. Advantageous refinements of the invention are the subject matter of respectively dependent claims.

According to one aspect of the invention, a drainage device is provided, in particular for a shaft window. The drainage device has a vertically movable valve part with a valve head, preferably valve cone, and an immovable valve part with a drain which can be closed by the valve head.

According to the invention, the vertically movable valve part is arranged on a counterweight.

The counterweight can be, for example, a counterweight of a shaft window or of other opening mechanisms.

By means of the arrangement of the vertically movable valve part on the counterweight, the movable valve part can be raised simultaneously with the weight or can be separated from the immovable valve part. The movable valve part is movable in particular because of the vertical movability of the counterweight and is fastened to the counterweight or is integrated in the counterweight. In the case of a shaft window, when the window is opened, the counterweight can be raised simultaneously with the valve head. By this means, the valve head is spaced apart from the drain and thus the drain is opened or exposed. The valve head is preferably configured as a valve cone, but may also have a different shape, for example may be spherical, rectangular, cylindrical and the like.

In the case of drainage mechanisms which are already known, the valve cone may stick in the valve housing if the spring force for the spacing apart is no longer of an adequate level because of material fatigue or soiling.

In the embodiment according to the invention, a direct connection of the valve or of the valve head to the counterweight ensures reliable opening of the valve head even when a valve seat is soiled.

The drainage device according to the invention makes it possible to avoid installing a complex mechanism, which has to be set individually, for drainage purposes.

Furthermore, costs, the outlay on manufacturing and the number of components used can be reduced. Owing to the smaller number of components which are used, quality assurance can be accelerated or improved with the same expenditure of time.

The drainage device can be usable, for example, in a window frame, a shaft window or a wall with a frame.

According to one embodiment, the valve head is connected to a guide rod in a closing direction of the drainage device and, in a closed state of the drainage device, is pressed against the drain relative to the position of the counterweight by a spring.

In order not to press against the valve head with an entire counterweight, a spring is arranged between the counterweight and the valve head. In the closed state of the drainage device, the spring can thus ensure a defined contact pressure against the valve head. Furthermore, manufacturing tolerances and wear of the valve head can be compensated for, even over the long term, by the spring travel and the spring.

The contact pressure of the valve head can preferably be optimized by an appropriate selection of the spring. The spring may also be used for different models of an embodiment of the window and/or of the counterweight. The functionality of the valve or the valve head can be ensured here by the contact pressure of the spring even in the event of wear phenomena. The spring can be configured in this connection as a spiral spring or as an elastic material.

According to a further embodiment of the drainage device, the guide rod of the valve head is received and guided by a sleeve, wherein the guide rod or the sleeve can be received in a vertically movable manner in a receiving portion of the counterweight. By this means, the sleeve can be positioned in a portion of the counterweight. The sleeve subsequently serves as a guide sleeve for the resilient movement of the valve head. Alternatively, the sleeve can be movable together with the guide rod at least in a unidimensionally movable manner in the receiving portion of the counterweight. The sleeve can thus act as a plain bearing.

According to a further embodiment of the drainage device, the closable drain has a sealing surface for receiving the valve head in regions in the closed state of the drainage device. The sealing surface can be configured, for example, as a conical recess in the drain or as a sealing ring. The sealing surface can preferably be configured in such a manner that a gas-tight or at least a leakage-free connection arises in conjunction with the valve head.

According to a further embodiment of the drainage device, the drain is a fluid-conducting connection through a window guide frame. By this means, the drain can be exposed in an opened state of the drainage device and thus when the valve head is spaced apart from the sealing surface, as a result of which collected liquid can flow out of a collecting basin or an installation frame through the drain. Optimum drainage can thus be realized.

According to a further embodiment of the drainage device, the guide rod has a detent on a side opposite the valve head. At the detent, the valve head can likewise be raised by raising of the counterweight. Furthermore, the detent can counter the spring which can be arranged on a side of the receiving portion of the counterweight that is opposite the detent. The spring can thus be pretensioned between the valve head and a side of the receiving portion by means of the detent.

According to a further aspect of the invention, a window is provided, in particular for a rail vehicle. The window has at least one open position and a closed position. Furthermore, the window has a window pane arranged in a movable sliding frame, wherein the movable sliding frame is arranged in a window guide frame and is connected to a counterweight. According to the invention, at least one drain is introduced in a lower region of the window guide frame, wherein at least one valve head which is oriented with respect to the at least one drain for closing or for opening the at least one drain is arranged on the counterweight.

The window may be in particular a shaft window of a rail vehicle. The at least one drainage valve is directly integrated here in the window counterweight. As soon as the window is opened, the valve or the at least one valve head is raised together with the counterweight. By this means, the at least one drain is opened, as a result of which collected water can escape through the outflow.

The integrated drainage device means that additional components can be omitted while simultaneously increasing the functionality. An additional valve guide, valve linkage or valve housing with an extensive spring assembly is not required. Furthermore, extensive retrospective adjustment measures for ensuring the functionality can be avoided.

The direct connection of the at least one valve head to the counterweight permits reliable opening of the drainage device even if a valve is soiled or stuck since higher tensile forces can act on the counterweight.

According to one embodiment of the window, the at least one drain can be moved into an open state or a closed state by the at least one valve head depending on a position of the counterweight. By this means, a state of the drainage device which is integrated in the window can depend directly on a position of the counterweight. The counterweight is coupled to the window frame, for example via cable pulls, and therefore opening of the window results in raising of the counterweight and thus in opening of the drainage device. A drainage operation can therefore be initiated by opening the window. Components for separately opening and closing the drainage device can thus be omitted.

According to a further embodiment of the window, in a closed state of the at least one drain, the at least one valve head is pressed against a sealing surface of the at least one drain by a spring. By this means, a constant contact pressure force of the valve head against a sealing surface of the drain can be realized. The contact pressure force can preferably compensate for manufacturing tolerances and small differences in height of the counterweight in the closed state of the window and can ensure the functioning capability and optimum sealing effect even if the valve head is worn.

According to a further embodiment of the window, the drain is a pipe or a hose and is arranged in a positionally fixed manner on the window guide frame. By this means, the drain can be positioned, for example, in a passage of the window guide frame or of a wall frame. In particular, the drain can thereby be configured in a technically simple manner, as a result of which already existing components can be used for this purpose.

According to a further embodiment of the window, the at least one valve head is arranged movably in at least one portion of the counterweight. Preferably, the valve head is arranged not only in a manner spring-stressed vertically, but also has at least slight horizontal movability. The valve head can thereby permit centering compensation. An optimum seat of the at least one valve head on the at least one sealing surface is thus possible, resulting in an optimum sealing action of the drainage device.

The above-described properties, features and advantages of this invention and the manner in which they are achieved will become clearer and more clearly comprehensible by the explanation of the greatly simplified schematic illustrations of preferred exemplary embodiments below.

DETAILS DESCRIPTION OF THE INVENTION

In the figures, the same structural elements each have the same reference numbers.

Figure 1:
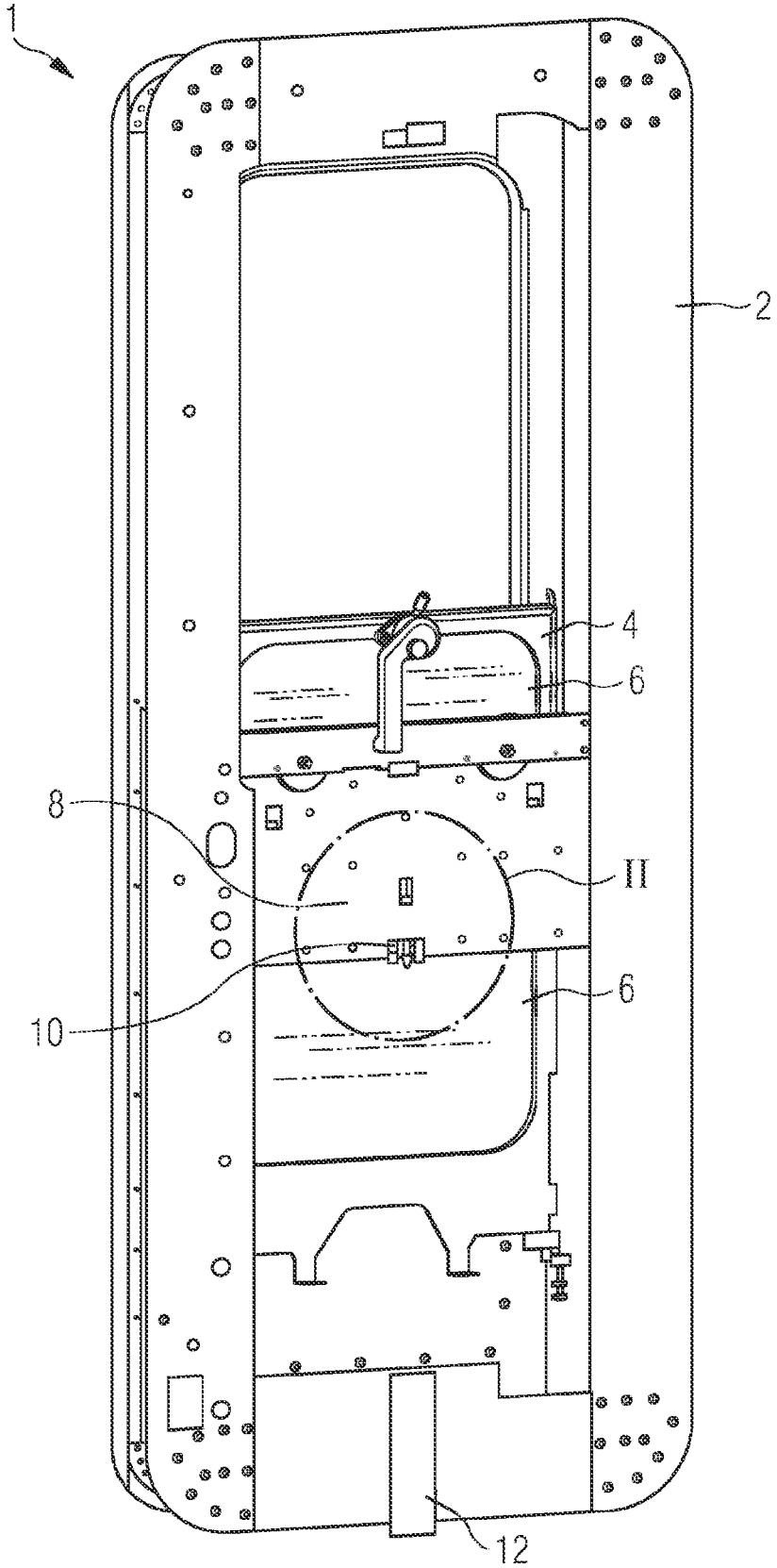
FIG. 1 shows a schematic illustration of a shaft window according to one embodiment of the invention.

FIG. 1 shows a schematic illustration of a shaft window 1 according to one embodiment of the invention. The shaft window 1 is illustrated in an open position.

The shaft window 1 has a window guide frame 2. A sliding frame 4 with a window pane 6 is arranged in a vertically movable manner in the window guide frame 2. The shaft window 1 is illustrated in an open position of the window pane 6.

The sliding frame 4 together with the window pane 6 is connected to a counterweight 8 via cable pulls (not illustrated) and deflecting pulleys such that a dead weight of the sliding frame 4 and of the window pane 6 during manual operation is compensated for.

The counterweight 8 is likewise arranged here in a vertically movable manner in the window guide frame 2 and so as to be guided by the window guide frame 2.

According to the exemplary embodiment, in a lower region of the counterweight 8, a movable valve part 10 is integrated in the form of a spring-tensioned valve wedge in the counterweight 8.

An immovable valve part 12 is arranged on a lower portion of the window guide frame 2. The immovable valve part 12 is positioned under the movable valve part 10 in the sliding direction or in the closing direction of the window 1.

Figure 2:
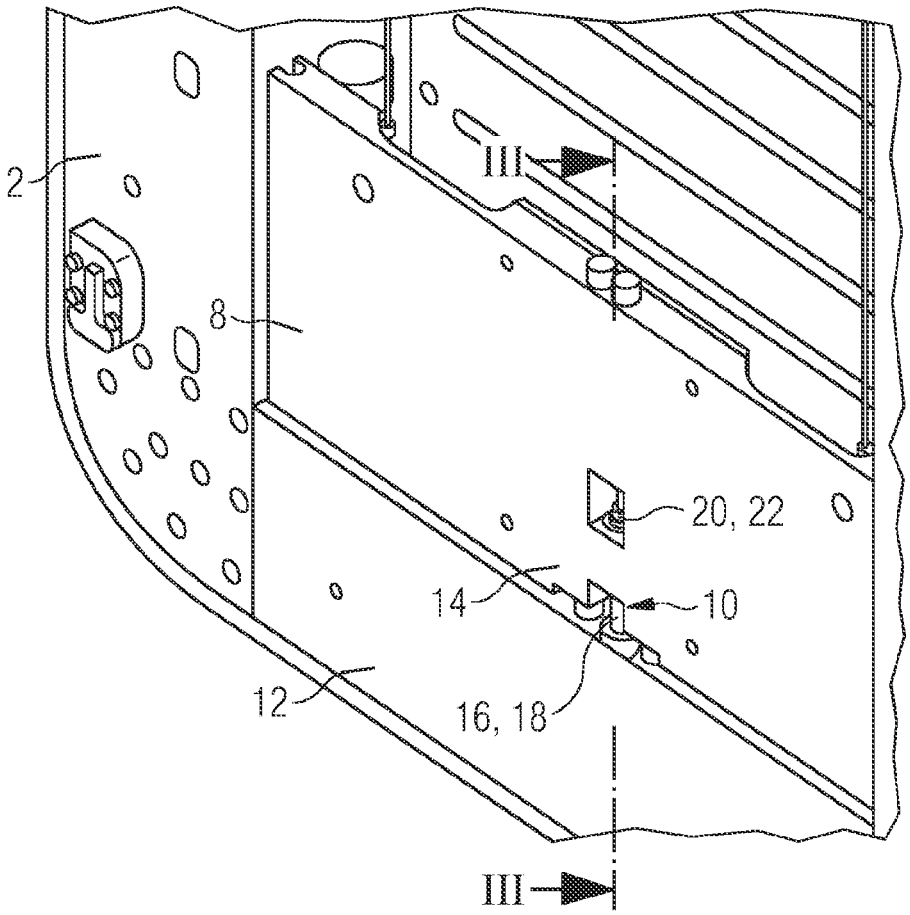
FIG. 2 shows a detailed view II of the shaft window from FIG. 1.

FIG. 2 shows a detailed view II of the shaft window from FIG. 1. The window 1 is illustrated here in a closed position, as a result of which the counterweight 8 takes up a vertically lowermost position within the window sliding frame 2.

A receiving portion 14 for receiving the valve head 16 and a valve sleeve 18 is introduced in a lower region of the counterweight 8. By this means, the valve head 16 can be fastened in a technically simple manner to the counterweight 8 by means of a detent 20.

The detent 20 is realized here in the form of a nut 20 on a guide rod 22 configured as a threaded rod. The threaded rod 22 is fastened on one side to the valve head 16, extends through the sleeve 18 and the receiving portion 14 of the counterweight 8 and is fixed at a second end of the receiving portion 14 by the nut 20.

Owing to the lowermost position of the counterweight 8, the valve head 16 of the movable valve part 10 is pressed into the immovable valve part 12 such that no liquid or gas can escape through the immovable valve part 12.

Figure 3:
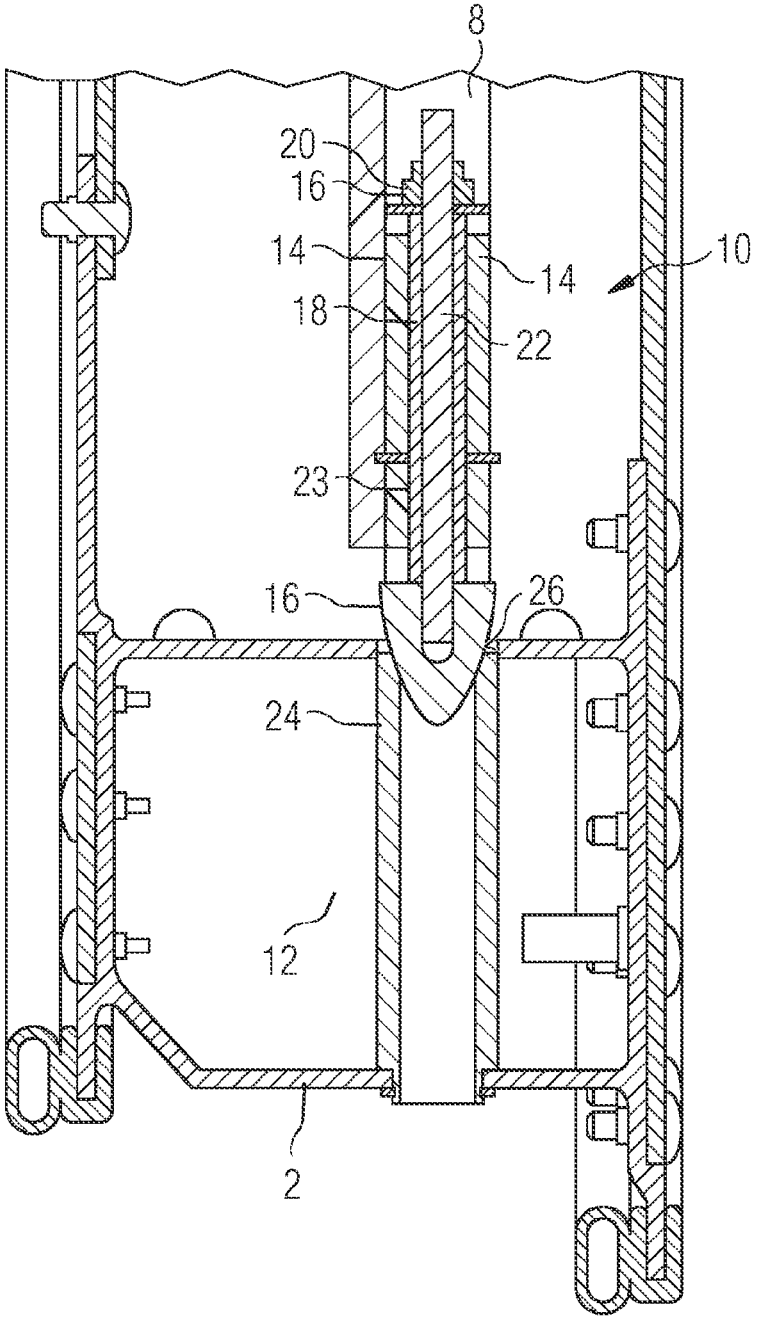
FIG. 3 shows a schematic sectional illustration III-III of the shaft window from FIG. 2.

FIG. 3 illustrates a schematic sectional view III-III of the shaft window 1 from FIG. 1 and FIG. 2. In particular, an exemplary design of the drainage device 10, 12 is shown in detail here.

The drainage device consists of a movable valve part 10, which is positioned on the receiving portion 14 of the counterweight 8, and of an immovable valve part 12, which is arranged on a lower portion of the window guide frame 2.

The movable valve part 10 has a valve head 16 which is connected to a guide rod 22 on the end side. The valve head 16 can be composed here of a metal or a plastic and is preferably formed conically.

The guide rod 22 extends through a sleeve 18 which is screwed against the valve head 16 by the nut 20. The sleeve 18 serves, for example, as a plain bearing in the receiving portion 14 of the counterweight 8. In the closed state of the window 1, the valve head 16 is pressed by a lower region of the receiving portion 14 against the immovable valve part 12 via a spring 23. The valve head, preferably valve cone, is thus pressed thereagainst with a defined, adaptable force which is smaller than the weight force of the counterweight.

The immovable valve part 12 has a drain 24 for conducting water out of the window guide frame 2. The drain 24 is positioned in a positionally fixed manner in the lower part of the window guide frame 2 and has a sealing surface 26 which is oriented vertically in the direction of the counterweight 8. The sealing surface 26 serves for receiving the valve head 16 and is designed here as a conically shaped recess in the drain 24.

The invention claimed is:

1. A shaft window drainage device, comprising:

a vertically movable valve part having a valve head;

an immovable valve part having a drain, said drain being closed by said valve head; and a vertically movable counterweight of a shaft window, said vertically movable valve part is fastened in said vertically movable counterweight such that, if the shaft window is opened, said vertically movable valve part is raised simultaneously with said vertically movable counterweight and is separated from said immovable valve part, and therefore said valve head is spaced apart from said drain and thus said drain is opened.

2. The shaft window drainage device according to claim 1, further comprising:

a spring; and a guide rod, said valve head is connected to said guide rod in a closing direction of the shaft window drainage device and, in a closed state of the shaft window drainage device, said valve head is pressed against said drain relative to a position of said vertically movable counterweight by said spring.

3. The shaft window drainage device according to claim 2, further comprising a sleeve, said guide rod is received and guided by said sleeve, wherein said guide rod or said sleeve being received in a vertically movable manner in a receiving portion of said vertically movable counterweight.

4. The shaft window drainage device according to claim 2, wherein said guide rod has a detent on a side opposite said valve head.

5. The shaft window drainage device according to claim 1, wherein said drain has a sealing surface for receiving said valve head in regions in a closed state of the shaft window drainage device.

6. The shaft window drainage device according to claim 1, wherein said drain is a fluid-conducting connection through a window guide frame.

7. A rail vehicle shaft window having at least one open position and a closed position, the rail vehicle shaft window comprising:

a movable sliding frame;

a window pane disposed in said movable sliding frame;

a window guide frame;

a vertically movable counterweight, said movable sliding frame being disposed in said window guide frame and connected to said vertically movable counterweight;

a drain being introduced in a lower region of said window guide frame, a vertically movable valve part having a valve head being oriented with respect to said drain and disposed for closing or for opening said drain;

an immovable valve part having said drain, said drain being closed by said valve head; and said vertically movable valve part being fastened to said vertically movable counterweight such that, if the rail vehicle shaft window is opened, said movable valve part is raised simultaneously with said vertically movable counterweight and is separated from said immovable valve part, and therefore said valve head is spaced apart from said drain and thus said drain is opened.

8. The window according to claim 7, wherein said drain has a sealing surface; and further comprising a spring, wherein in a closed state of said drain, said valve head is pressed against said sealing surface of said drain by said spring.

9. The window according to claim 7, wherein said drain is a pipe or a hose and is disposed in a positionally fixed manner on said window guide frame.

* * * * *